US005941324A

United States Patent [19]

Bennett

[11] Patent Number: 5,941,324

[45] Date of Patent: Aug. 24, 1999

[54] DRILLING APPARATUS

[75] Inventor: Norman L. Bennett, Exton, Pa.

[73] Assignee: Schramm, Inc., West Chester, Pa.

[21] Appl. No.: 09/014,338

[22] Filed: Jan. 27, 1998

[51] Int. Cl.[6] ..... E21B 19/14

[52] U.S. Cl. ..... 175/85; 166/77.51

[58] Field of Search ..... 175/52, 85, 57; 166/77.51, 77.52

[56] References Cited

U.S. PATENT DOCUMENTS

| | | | |
|---|---|---|---|
| 4,449,592 | 5/1984 | Mayer | 175/52 |
| 4,591,006 | 5/1986 | Hutchison et al. . | |
| 4,718,805 | 1/1988 | Becker . | |
| 4,854,400 | 8/1989 | Simpson . | |
| 5,354,150 | 10/1994 | Canales | 166/77.52 X |
| 5,423,390 | 6/1995 | Donnally et al. | 175/85 |
| 5,458,454 | 10/1995 | Sorokan . | |

FOREIGN PATENT DOCUMENTS 2 219 613 12/1989 United Kingdom .

OTHER PUBLICATIONS

Abstract and Drawings of Australian Patent Application No. AU–A–64377/96 Published Mar. 6, 1995.

*Primary Examiner*—Frank Tsay
*Attorney, Agent, or Firm*—Howson and Howson

[57] ABSTRACT

A mobile rig for angle drilling comprises a tiltable drilling mast and a drill pipe storage rack both mounted on a land vehicle, with a carriage movable lengthwise on a track extending alongside the mast. When the mast is in an oblique position for angle drilling, an articulating arm on the carriage retrieves drill pipes individually from the pipe storage rack, swings them to a position above the mast and lowers them into alignment with a drilling head. The storage rack is moved longitudinally as the drill pipe supply is depleted so that the arm can grasp each drill pipes close to its center of gravity. In an alternative embodiment, one of the elements of the articulating arm is extensible.

5 Claims, 8 Drawing Sheets

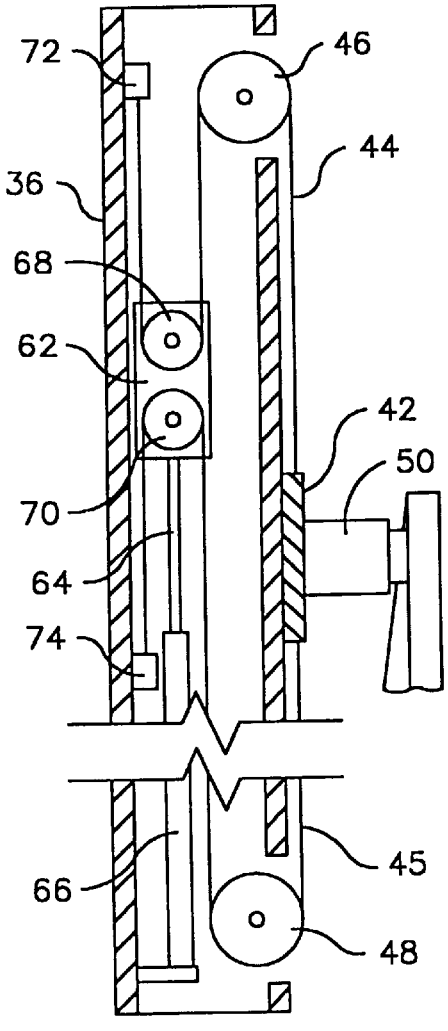
Fig. 7
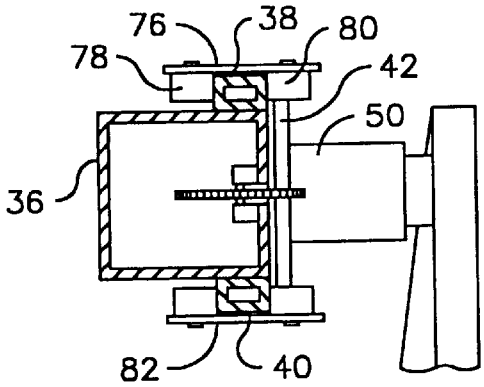
Fig. 8
Fig. 9
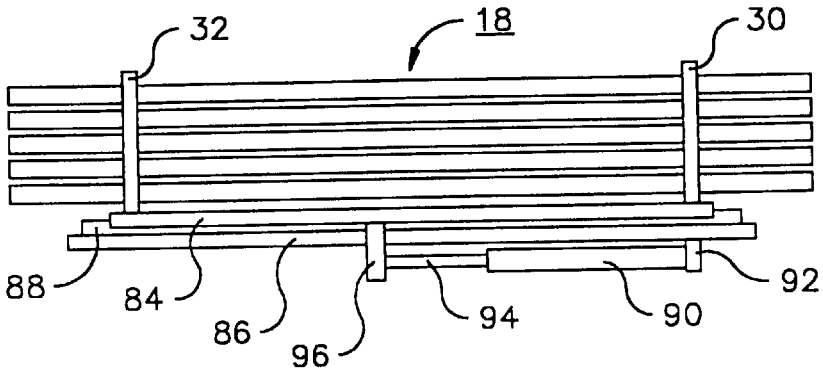

DRILLING APPARATUS

SUMMARY OF THE INVENTION

This invention relates to earth drilling, and more particularly to a novel method and apparatus for handling drill pipe in a drill rig capable of angle drilling.

In typical vehicle-mounted drill rigs, drill pipe is transferred between a drill pipe storage rack and the drilling mast by a cable hoist. The cable hoist is generally satisfactory for vertical drilling, since, when the hoisting cable is connected to an end of a length of drill pipe, the drill pipe automatically tends to assume a vertical condition when raised. In various applications of a mobile drill rig, such as exploration, construction, oil, gas and water recovery and utility placement, and particularly in geologic chip sampling, it is frequently desirable to drill into the earth obliquely. However, in "oblique," "angle" or "directional" drilling, it is far more difficult to manage the drill pipe. Injuries and equipment damage occur more frequently than is the case in vertical drilling. To overcome the difficulties and dangers encountered in drill pipe handling, especially in angle drilling, drill pipe carousels have been developed. In a typical carousel-type angle drilling rig, a carousel is mounted alongside the drilling mast for drill pipe storage, and a transfer mechanism is provided for moving sections of drill pipe between the carousel and the drill string. The carousel, however, has a severely limited pipe storage capacity, which limits the drilling depth.

Among the important objects of this invention are simplicity, reliability, safety and low cost in a drill pipe handling system.

This invention addresses the foregoing objects by providing a carriage which is movable lengthwise on a track extending alongside the mast. When the mast is in an oblique condition for angle drilling an articulating arm on the carriage retrieves drill pipes individually from a pipe storage rack, swings them to a position above the mast and lowers them into alignment with the drilling head.

More specifically, the drilling apparatus in accordance with the invention comprises an elongated mast having upper and lower ends. The mast has a drilling head for rotating a drill string, and a mechanism for moving the drilling head along the length of the mast. For angle drilling, the mast is mounted on a support capable of holding the mast in an oblique position relative to the horizon. A supply of horizontal drill pipe sections is provided in a storage rack. A carriage is guided by a track extending alongside the mast for movement in a direction parallel to the direction of elongation of the mast.

A pipe transfer arm on the carriage can be thought of as roughly analogous to the arm of a human being. It has two principal elements: a humeral element corresponding to the upper arm of a human being, and an ulnar element, corresponding to the forearm. The humeral element is mounted on the carriage for swinging movement about a horizontal shoulder axis transverse to the direction of elongation of the mast. A shoulder actuator swings the humeral element about the shoulder axis. The ulnar element is mounted on the humeral element, for swinging movement about an elbow axis spaced from, but transverse to, the shoulder axis. An elbow actuator swings the ulnar element about the elbow axis. A pipe clamp is mounted on the ulnar element at a location remote from the elbow axis. The combined lengths of the humeral and ulnar elements of the pipe transfer arm are such that the carriage can be moved toward the upper end of the mast, to a location in which the pipe clamp is above and clear of the drill pipe storage rack. The relative lengths of the humeral and ulnar elements of the pipe transfer arm are such that, when the humeral element is swung to a position in which it extends upward in a direction substantially perpendicular to the direction of elongation of the mast, the ulnar element can swing the pipe clamp into a position in which a pipe held in the pipe clamp is aligned with the drilling head along a drill string axis parallel to the direction of elongation of the mast.

In the operation of the preferred embodiment of the drilling apparatus, the carriage is at an intermediate location along the length of the mast and the articulating arm initially extends downward from the carriage toward the drill pipe supply in the storage rack. The drill pipes are disposed in side-by-side columns in the rack, and the columns are spaced from one another to permit the grasping clamp to grasp individual pipes. At this time, the grasping clamp is positioned at a level above the uppermost drill pipe in a selected column of pipes. The elbow actuator is operated to move the ulnar element laterally and thereby position the grasping clamp directly above the pipes in the selected column. The carriage is then moved downward along the track until the grasping clamp engages the uppermost drill pipe in the selected column. After the clamp grasps the uppermost pipe in the selected column, the carriage is moved up the track, thereby raising the grasped drill pipe until so that it is well above the storage rack. The shoulder actuator is then operated, swinging the pipe upward to a position in which it is above and parallel to the mast. Then, the carriage is again moved downward along the track and the elbow actuator is operated to move the pipe into alignment with the drilling head. The drill pipe can then be connected to the drill string. A drill pipe can be returned to the storage rack by reversal of the above steps.

In a preferred embodiment, the drill pipe storage rack is supported by the same support that holds the mast, and is movable relative to the support in a horizontal direction parallel to a vertical plane in which the direction of elongation of the mast lies. By moving horizontally as the supply of drill pipe is depleted, the drill pipe storage rack enables the pipe-grasping clamp to grasp each pipe near its center of gravity. The storage rack can also be moved to accommodate various different drilling angles.

The drilling apparatus is preferably a mobile apparatus, in which the mast support is a land vehicle, in which the mast is tiltable on the vehicle from a traveling position in which its direction of elongation is horizontal at least to an oblique position for angle drilling, and in which the drill pipe storage rack is situated alongside the mast when the mast is in its traveling position.

In a modified embodiment of the invention, the articulating pipe transfer arm comprises two elongated articulating elements at least one of which is longitudinally extensible.

As will be more readily apparent from the following detailed description, the articulating arm and pipe-grasping clamp hold the drill pipe rigidly throughout its movement between the storage rack and the drill string, thereby reducing the safety hazards associated with cable hoisting, and permitting rapid and efficient handling of the drill pipe.

Other objects, details and advantages of the invention will be apparent from the following detailed description when read in conjunction with the drawings.

BRIEF DESCRIPTION OF THE DRAWINGS

FIG. 7 is a vertical section taken longitudinally through the track extending alongside the mast, showing the carriage and the carriage driving mechanism;

FIG. 8 is a transverse section through the track;

FIG. 9 is an elevational view of the drill pipe storage rack, showing the storage rack support and the mechanism for moving the rack horizontally.

DETAILED DESCRIPTION

Figure 1:
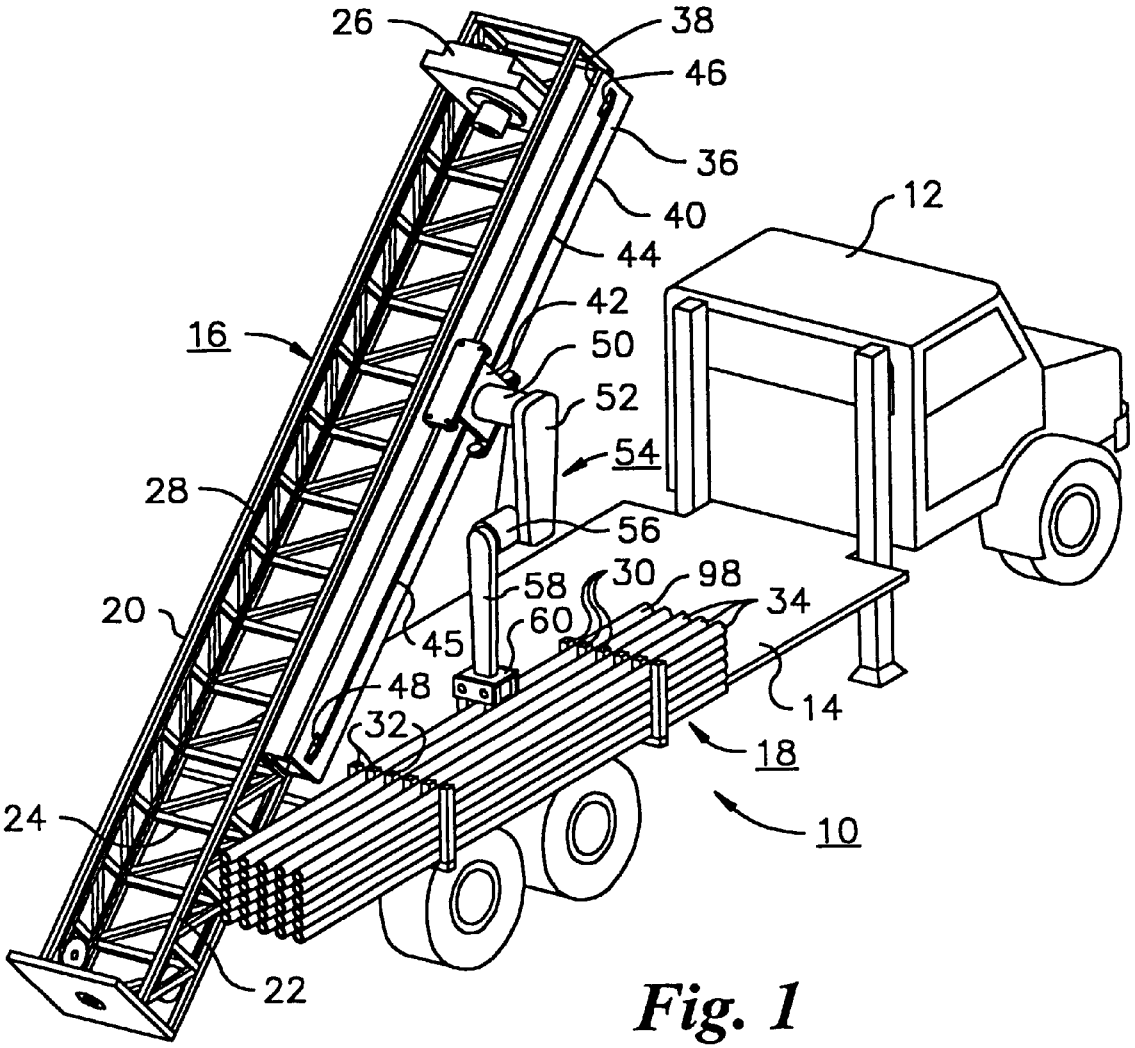
FIGS. 1–6 are schematic perspective views of a portable drilling apparatus illustrating successive steps in the transfer of a length of drill pipe from a drill pipe storage rack to a drill string.

FIG. 1 illustrates a portable drill rig 10 comprising a vehicle having a cab 12 and a bed 14 on which are carried a drilling mast 16, a drill pipe storage rack 18 and various other components such as air compressors, hydraulic pumps, controls etc. (not shown) used in the operation of the drilling mechanism.

The drilling mast 16 is an elongated mast, hinged at the rear of the vehicle and preferably movable from a horizontal condition for transporting, at least to the oblique condition shown, for angle drilling. The mast is also preferably movable to a vertical position for vertical drilling.

The drilling mast comprises left and right sides 20 and 22 and a front/bottom 24 all made up of a tubular steel framework. The top/rear side of the mast is open. A drill head 26, having a drill stem rotating mechanism, is movable lengthwise along the mast by a pair of chains adjacent to the sides 20 and 22, one such chain 28 being shown in FIG. 1 alongside the left side 20 of the mast.

The drill pipe storage rack 18 comprises two sets, 30 and 32, of vertical separator posts. Drill pipes, e.g. pipes 34, are disposed in columns between adjacent posts, and extend horizontally in a direction parallel to an imaginary vertical plane bisecting the mast lengthwise. In the embodiment illustrated, each separator post set comprises six posts, and the drill pipes in the storage rack are arranged in five side-by-side columns.

A track 36 is fixed to right side 22 of the mast and extends lengthwise along the outside of the mast. The track has upper and lower guide rails 38 and 40, which are engaged by rollers on a carriage 42. The carriage is moved along the track by chains 44 and 45, which pass over sprockets 46 and 48 respectively. These sprockets are disposed in slots near opposite ends of the track and are driven by a hydraulic actuator mechanism inside the track, which will be described with reference to FIGS. 7 and 8.

A rotary actuator 50 is mounted on carriage 42, and is arranged to rotate the upper, or humeral, element 52 of an articulating arm 54 about a horizontal axis extending laterally in a direction transverse to the direction of elongation of the mast, preferably perpendicular to the above-mentioned imaginary vertical plane.

The rotary actuator is preferably a high torque hydraulic actuator having an axially movable piston carrying an outer helical spline, engaging splines in a fixed ring, and an inner helical spline engaging outer splines on an output shaft. Such actuators are particularly suited for producing the high torque and large rotation angle required in this drill pipe transfer apparatus. Suitable rotary actuators are available from Helac Corporation Inc. of Enumclaw, Wash., Schrader Bellows of Wadsworth, Ohio and Flo-Tork, Inc. of Orrville, Ohio.

A similar actuator 56 is mounted at the end of humeral element 52 remote from actuator 50, and is arranged to rotate a lower, or ulnar, element 58 about an axis, spaced from and transverse to, the axis of rotation of actuator 50. The axis of rotation of actuator 56 is preferably perpendicular to a plane in which the axis of rotation of actuator 50 lies. A pipe grasping clamp 60, with drill pipe gripping jaws, is provided on the end of ulnar element 58 remote from actuator 56.

As will be apparent from an inspection of FIGS. 1–6, actuator 50 serves as a shoulder for the articulating arm 54, allowing it to swing about a horizontal shoulder axis, and actuator 56 serves as an elbow, allowing the ulnar element 58 to swing about an elbow axis spaced from, but transverse to, the shoulder axis.

FIG. 7 shows a block 62 inside the track 36 and connected to the piston 64 of a two-way hydraulic actuator 66. The block is movable longitudinally within the track through a distance equal to one-half the stroke of the carriage 42. The block carries a pair of sprockets 68 and 70. Chain 44 is connected at one end to an anchor 72, and is wrapped around sprockets 68 and 46 and connected to the carriage. Chain 45 is connected at one end to an anchor 74, and is wrapped around sprockets 70 and 48 and connected to the carriage. A movement of the piston of the hydraulic actuator 66 through a given distance in either direction causes the carriage to move through twice that distance in the opposite direction. Thus, the carriage can be moved to any selected position on the track by operation of the hydraulic actuator.

As shown in FIG. 8, the carriage 42 is guided on the track by the engagement of rollers on the carriage with guide rails 38 and 40. An upper plate 76 on the carriage supports four rollers, two of which are seen at 78 and 80 in FIG. 8 in engagement with rail 38. Similar rollers are provided on a lower plate 82 for engagement with guide rail 40.

In the drill pipe storage rack, as shown in FIG. 9, separator posts 30 and 32 extend upwardly from a base 84. The base is supported by a horizontal plate 86 and guided by a guide rail 88 for horizontal movement parallel to a vertical plane in which the direction of elongation of the mast lies. Movement of the rack is effected by a two-way hydraulic actuator comprising a cylinder 90 mounted to a bracket 92 on plate 86, and a piston 94 connected to a bracket 96 on the base 84 of the storage rack.

The actuator enables the operator to move the pipe storage rack rearward as the supply of pipe is depleted so that the grasping clamp 60 can grip each pipe as near as possible to its center of gravity. This avoids excessive torque loads on the articulating arm, especially on the ulnar element 58 and the elbow actuator 56. It also ensures that the lower pipes in the supply clear the cab 12 as the carriage moves upward on the track and that they clear the bed 14 as the shoulder actuator rotates. The position of the drill pipe storage rack can also be adjusted to accommodate different drilling angles. For example, as the drilling angle approaches vertical, the storage rack can be moved rearward to enable the pipe grasping clamp to grip the drill pipes near their centers of gravity.

In the transfer of a drill pipe section from the storage rack to the drill string, the carriage is initially near the upper end of the track 36. With the humeral element 52 of the articulating arm extending vertically downward, the elbow actuator 56 is operated to position the grasping clamp 60 above a selected drill pipe section. The carriage is then moved downward along the track until the grasping clamp 60 engages a pipe section, e.g. pipe section 98, as shown in FIG. 1. The grasping clamp is then operated so that it grips the pipe section.

Figure 2:
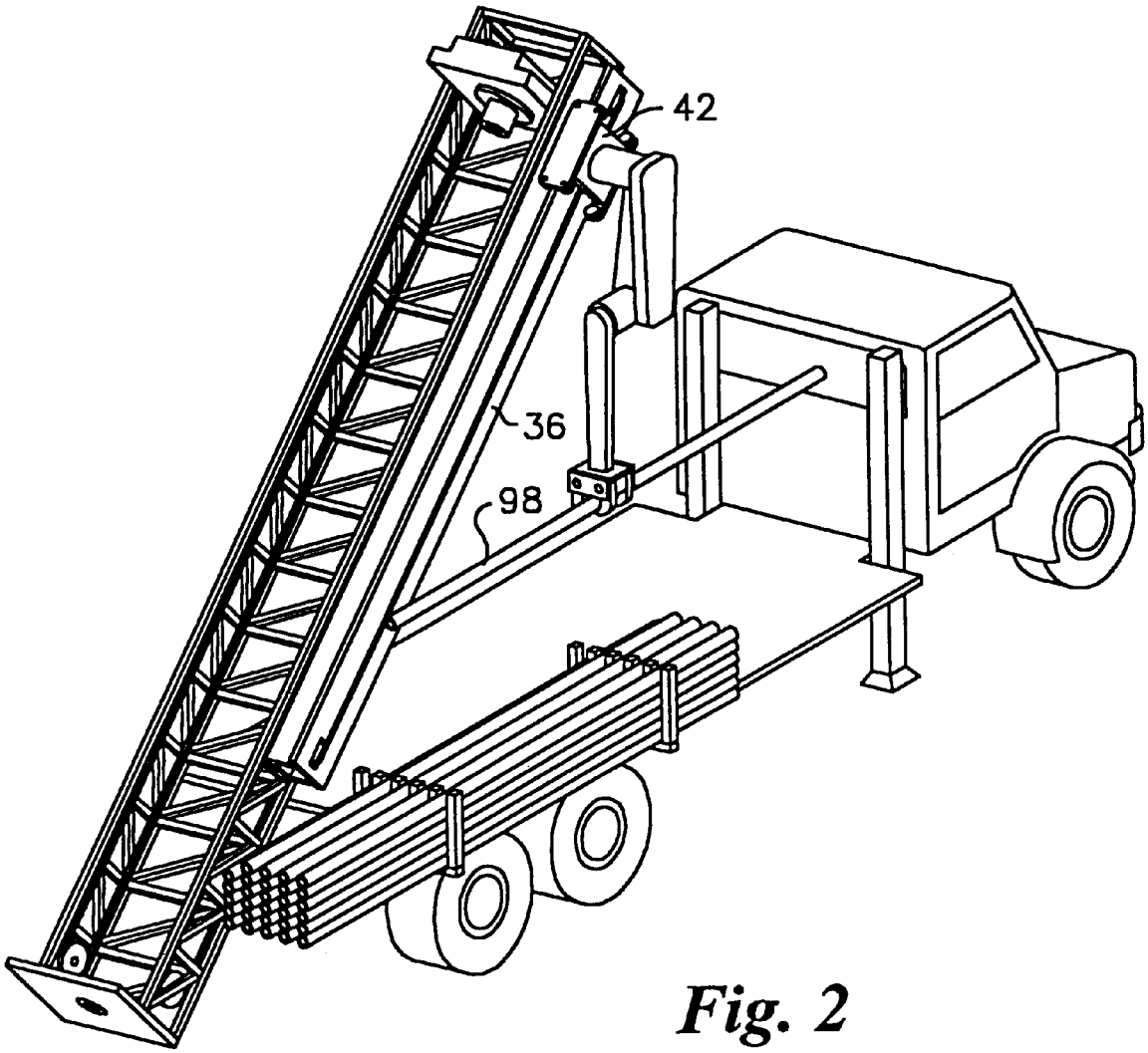
Figure 3:
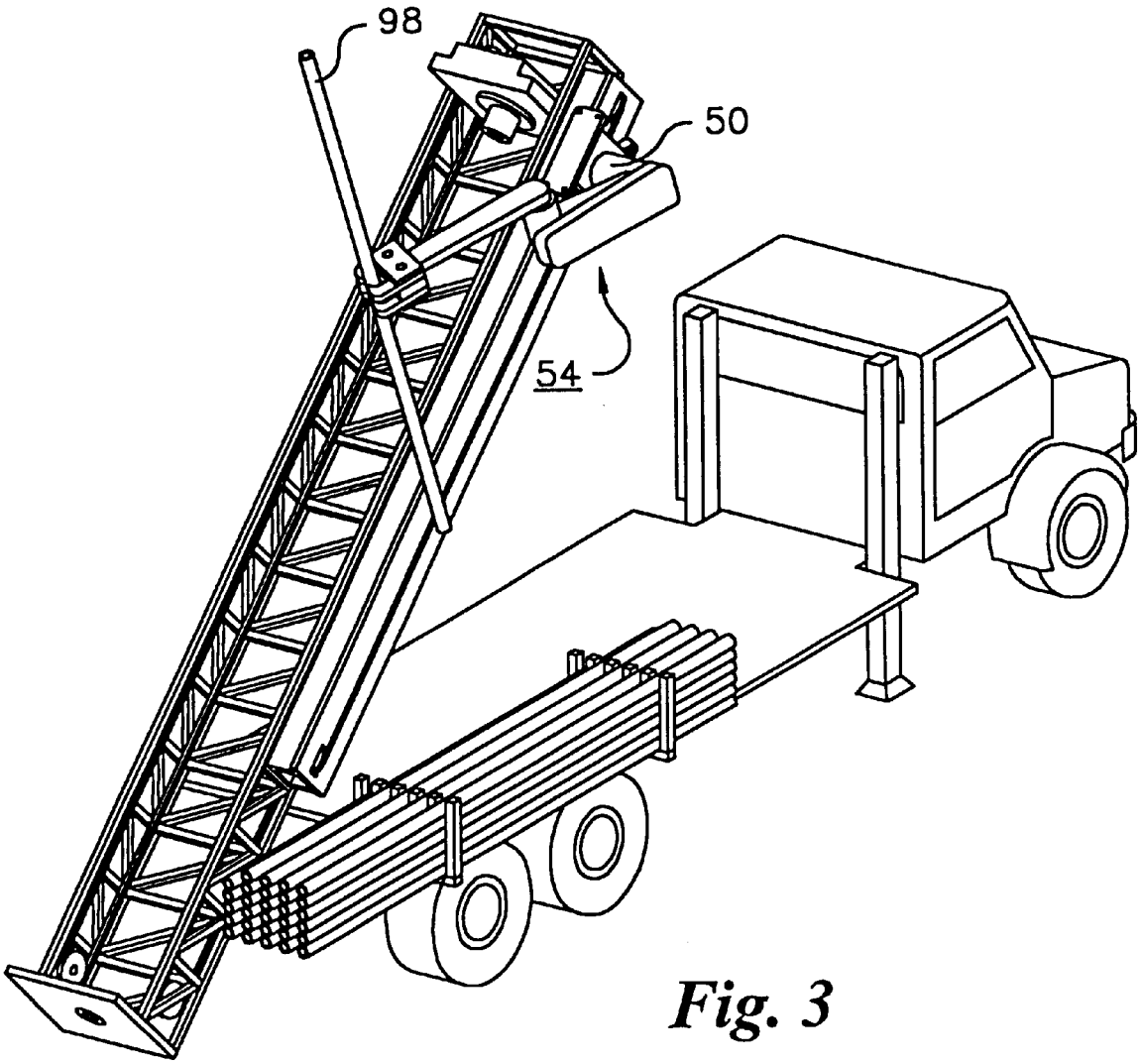

The carriage 42 is then moved upward along the track 36 as shown in FIG. 2, lifting the pipe section 98, while maintaining it in a horizontal condition. With the carriage at the upper end of its stroke, the shoulder actuator 50 is operated to swing the articulating arm 54 through the position shown in FIG. 3 to the position shown in FIG. 4, in which the drill pipe section 98 is parallel to the direction of elongation of the mast. The shoulder actuator, therefore, rotates through an angle equal to 90°+θ, where θ is the inclination of the mast from the vertical. Thus, if the drilling angle is 45°, the actuator 50 rotates the articulating arm 54 through an angle of 135°.

Figure 4:
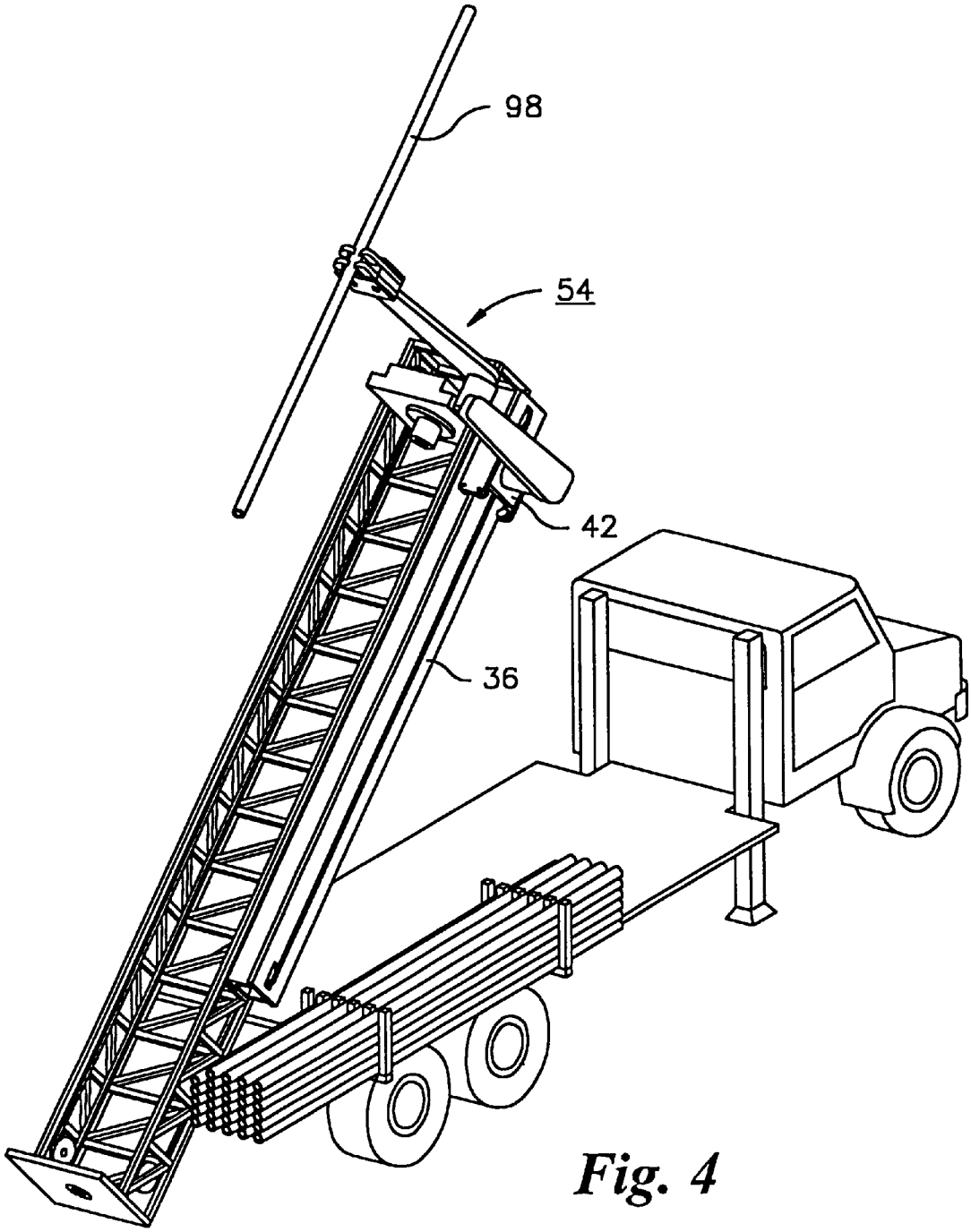
Figure 5:
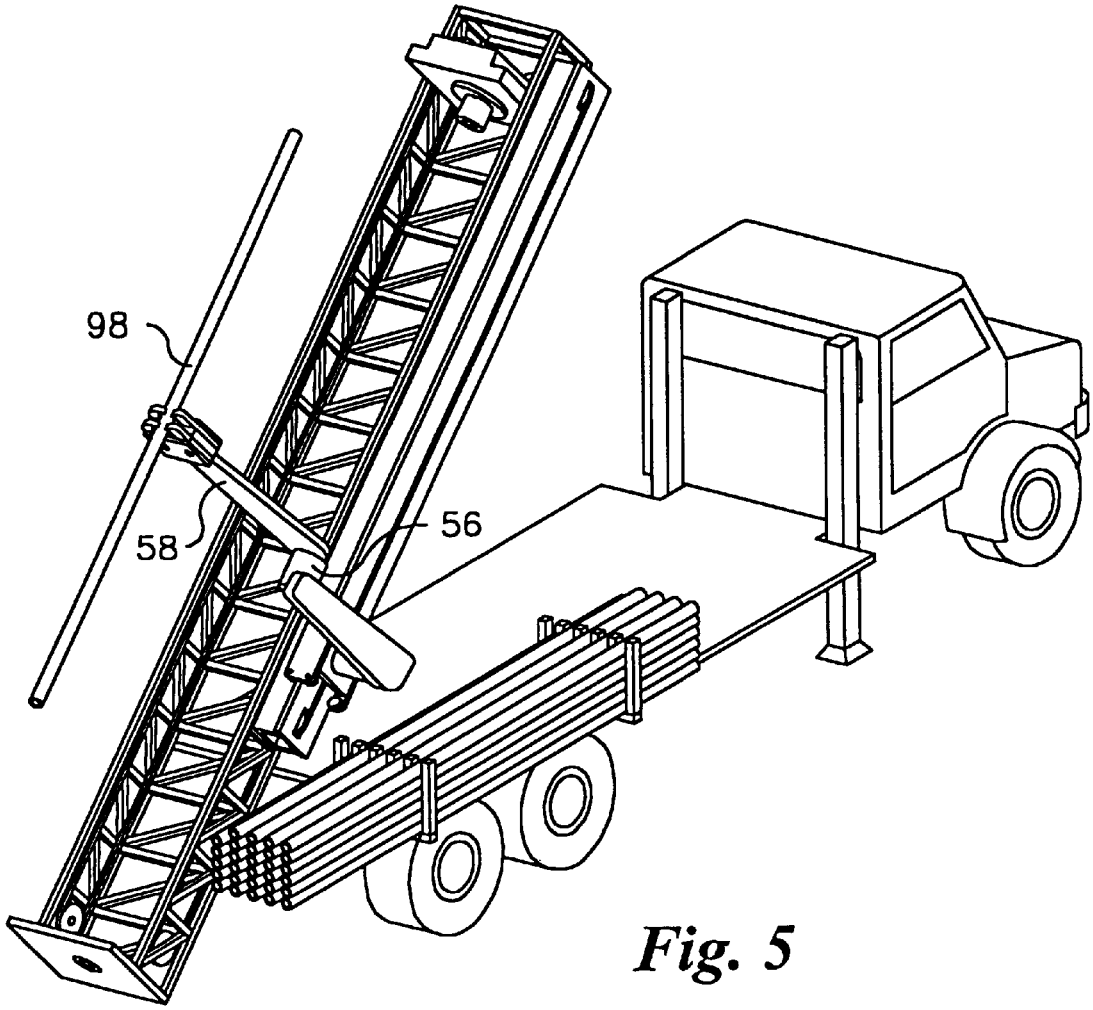

With the drill pipe parallel to the elongation of the mast, as in FIG. 4, the carriage 42 is moved down the track 36 to the position shown in FIG. 5. Then, the elbow actuator 56 is operated, swinging ulnar element 58 downward to place the pipe section in alignment with the spindle of the drilling head 26, whereupon the drill pipe can be moved axially through slipbox 100 by further downward movement of the carriage, so that a bit can be attached to it. Then, the drill head spindle is engaged with the upper end of the drill pipe section and the grasping clamp is disengaged from the drill pipe and withdrawn. The jaws of the grasping clamp should be capable of opening sufficiently wide to allow the grasping clamp to be disengaged from the drill pipe by swinging the ulnar element upward.

Figure 6:
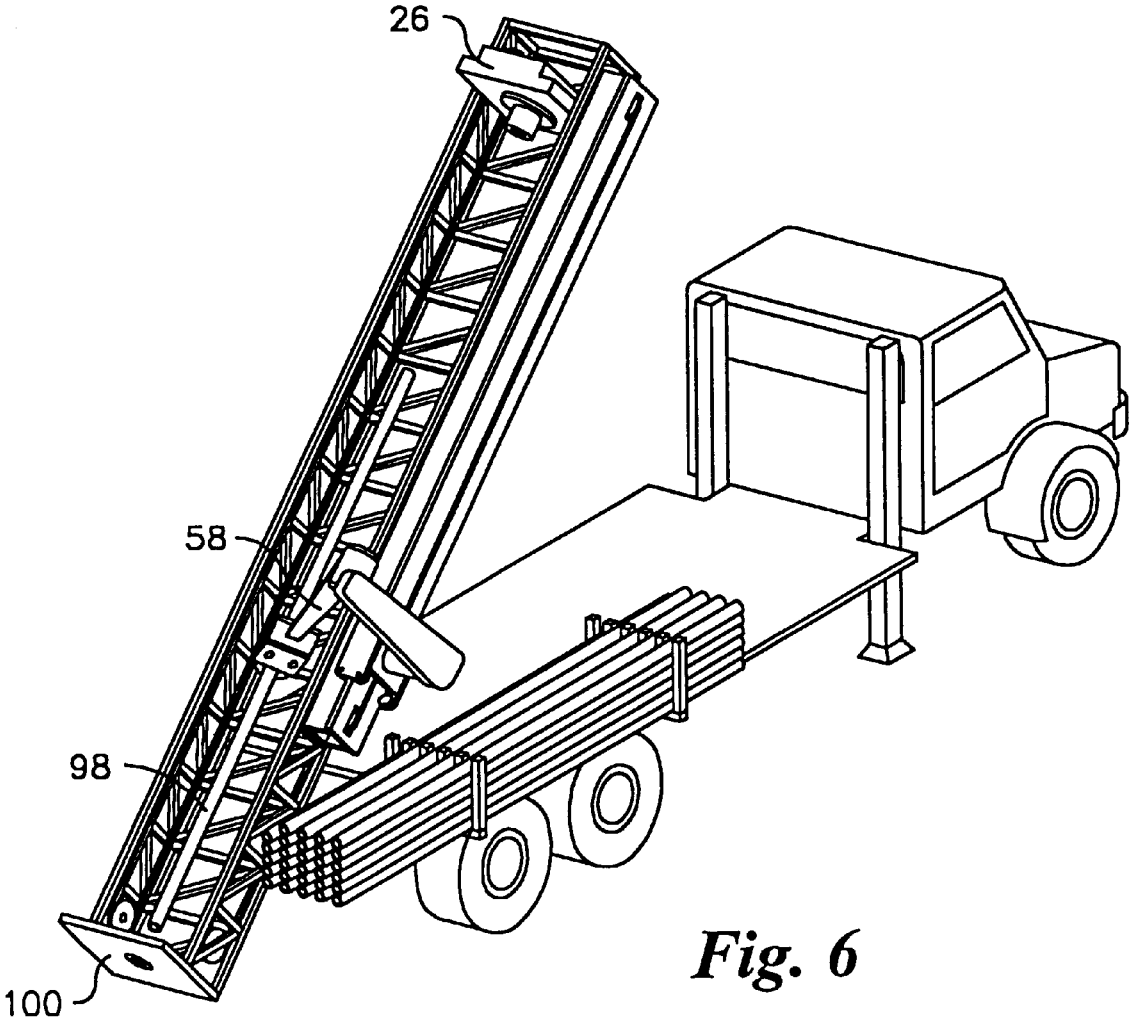

In the case where one or more sections of drill pipe are already in a borehole, the drill pipe section held by the grasping clamp can be attached to the previously assembled parts of a drill string, by positioning it as shown in FIG. 6, moving the drill head downward and engaging the spindle with the upper end of the drill pipe section, releasing and withdrawing the grasping clamp, and resuming drilling.

Additional drill pipe sections are transferred from the storage rack to the drill string following the same procedure. The grasping clamp can be positioned above any one of the columns of drill pipe in the storage rack by operation of actuator 56. Thus, drill pipe sections can be removed from the uppermost layer and then from successively lower layers in sequence. As the drill pipe is depleted, the storage rack is indexed rearward, by operation of the actuator in FIG. 9, so that the grasping clamp will grip each pipe section near its center of gravity.

In unloading a drill pipe section from the drill string and return it to the storage rack, the procedure is essentially the reverse of that depicted in FIGS. 1–6. The first step is to operate the drill head in order to withdraw the drill string until the uppermost drill pipe is within the mast. The next step is to break the joint between the uppermost drill pipe section and the next lower pipe section in the drill string. Then, the grasping clamp is engaged with the drill pipe section as in FIG. 6, and the upper end of the uppermost drill pipe section is released from the spindle.

The ulnar element 58 of the arm is then rotated upward by operation of the elbow actuator 58 to the position shown in FIG. 5. The carriage is then moved up along the track to the position shown in FIG. 4, and the entire arm is rotated by operation of the shoulder actuator, through the position depicted in FIG. 3 to the position depicted in FIG. 2. Then, by moving the carriage downward along the track, the drill pipe section held by the grasping clamp can be redeposited in the storage rack.

The apparatus allows a single operator to transfer pipe sections between the storage rack and the drill string quickly and safely. Furthermore, the apparatus can accommodate many more sections of drill pipe than a conventional mast-supported carousel.

Figure 10:
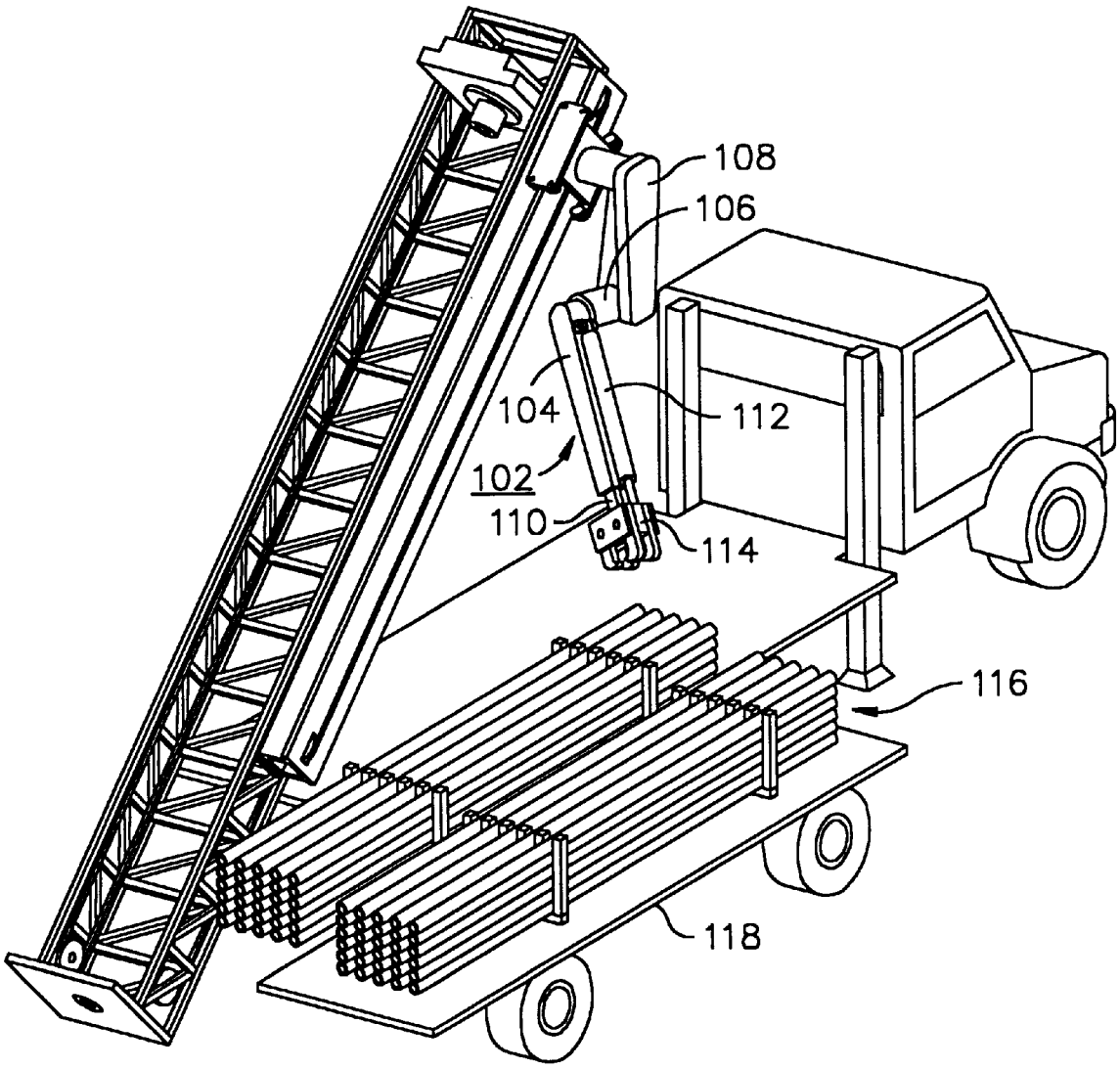
FIG. 10 is a schematic perspective view illustrating an alternative embodiment of the invention.

In the modified embodiment shown in FIG. 10, the ulnar element 102 of the articulating arm is extensible. A first part 104 of the ulnar element is connected to a rotary actuator 106 on humeral element 108, and a second part 110 is in telescoping relationship with element 104. A hydraulic cylinder 112, connected to element 104 and to the pipe grasping clamp 114 on the end of part 110, controls the movement of part 110, which slides into and out of part 104. The ulnar element 102 is therefore extensible.

The extensible ulnar element is not necessary if the entire drill pipe supply can be stored on a rig-mounted storage rack. However, in the case of deep drilling, additional drill pipe 116 may be stored on a secondary carrier 118 alongside the drill rig as shown in FIG. 10. The extensibility of the ulnar element enables the pipe grasping clamp to reach all of the drill pipe on the secondary carrier.

An extensible ulnar element can also be advantageous in positioning drill pipe sections in the drill string and in retrieving drill pipe sections from the drill string. The arm can be designed so that the pipe grasping element can be engaged with, and disengaged from, a drill pipe section in the drill string by extending and retracting the telescoping ulnar element, thereby obviating wide opening of the jaws of the pipe grasping element.

The extensible ulnar element also has the advantage that it enables drill pipe sections to be gripped at or near their centers of gravity without the necessity of moving the drill pipe storage rack longitudinally.

Various modifications can be made to the apparatus described. For example, the mast and drill pipe storage rack can be mounted on various types of vehicles including track vehicles. The shoulder and elbow actuators can take various forms. For example, geared hydraulic or electrical actuators can be used. It is even possible to utilize compound piston actuators to achieve the necessary degree of angular rotation. The apparatus can be designed so that the drill pipe sections move over the top of, or alongside, the cab as the carriage moves up the track, or alternatively so that the drill pipe sections approach the rear of the cab without touching it. In operation, the ulnar element can be made to swing laterally outward immediately after a drill pipe section is lifted out of the storage rack, in order to clear the cab or other equipment on the vehicle.

Optionally, either or both of the elements of the arm can be made extensible to facilitate drill pipe handling, especially in the case of an auxiliary drill pipe storage rack.

Although the apparatus is primarily intended for angle drilling, it can be modified for use in vertical drilling by positioning the drill pipe storage rack so that the centers of gravity of the drill pipes are adjacent to the mast when the mast is vertical. The mechanism for moving the storage rack longitudinally can have a sufficient stroke to position the storage rack so that the drill rig can be used both for angle drilling and vertical drilling.

Still other modifications may be made to the apparatus and method described above without departing from the scope of the invention as defined in the following claims.

I claim:

1. A drilling apparatus comprising:

an elongated mast having upper and lower ends, a drilling head for rotating a drill string, and a mechanism for moving the drilling head along the length of the mast;

a support for the mast, the support being capable of holding the mast with its direction of elongation in an oblique relationship to the horizon for angle drilling;

a drill pipe storage rack for holding multiple sections of drill pipe horizontally;

a track extending alongside the mast;

a carriage guided by the track for movement along the track in a direction parallel to the direction of elongation of the mast;

a pipe transfer arm comprising an humeral element mounted on the carriage for swinging movement about a horizontal shoulder axis transverse to the direction of elongation of the mast, a shoulder actuator for swinging the humeral element about said shoulder axis, an ulnar element mounted on the humeral element, for swinging movement about an elbow axis, said elbow axis being spaced from, but transverse to, said shoulder axis, and extending substantially horizontally when the humeral element extends substantially vertically downward from the carriage, and an elbow actuator for swinging the ulnar element about said elbow axis; and a pipe clamp mounted on the ulnar element at a location remote from the elbow axis, the pipe clamp being arranged to support a drill pipe with the direction of elongation of the drill pipe substantially parallel to the elbow axis;

wherein the combined lengths of the humeral and ulnar elements of the pipe transfer arm are such that the carriage can be moved toward the upper end of the mast, to a location in which the pipe clamp is above and clear of the drill pipe storage rack;

wherein the relative lengths of the humeral and ulnar elements of the pipe transfer arm are such that, when the humeral element is swung to a position in which it extends upward in a direction substantially perpendicular to the direction of elongation of the mast, the ulnar element can swing the pipe clamp into a position in which a pipe held in the pipe clamp is aligned with the drilling head along a drill string axis parallel to the direction of elongation of the mast; and wherein the length of the ulnar element is sufficient to allow the clamp to be moved through a range of distances from the mast by rotation of the elbow actuator, whereby the clamp can pick up drill pipe from, and deposit drill pipe into any of a plurality of side-by-side columns of drill pipe in the drill pipe storage rack.

2. A drilling apparatus according to claim 1 in which, when the mast is supported by the support with its direction of elongation in an oblique relationship to the horizon, the direction of elongation of the mast is situated in, and defines, an imaginary vertical plane, and in which the drill pipe storage rack is also supported by the support and is movable relative to the support in a horizontal direction parallel to said imaginary vertical plane.

3. A drilling apparatus according to claim 1 in which the drill pipe storage rack includes means for supporting drill pipes in plural columns of horizontally disposed pipes, and for maintaining a spacing between the pipes of adjacent columns.

4. A drilling apparatus according to claim 1 in which the support comprises a land vehicle, in which the mast is tiltable on the vehicle from a traveling position in which its direction of elongation is horizontal at least to said oblique position, and in which the drill pipe storage rack is situated alongside the mast when the mast is in its traveling position.

5. A drilling apparatus according to claim 1 in which the ulnar element of the pipe transfer arm is elongated and longitudinally extensible.

* * * * *